US005560788A

United States Patent [19]

Yamada et al.

[11] Patent Number: 5,560,788

[45] Date of Patent: Oct. 1, 1996

[54] HEAT RESISTING STEELS

[75] Inventors: Masayuki Yamada; Yoichi Tsuda; Ryuichi Ishii, all of Yokohama; Eiji Maeda; Tsukasa Azuma, both of Muroran, all of Japan

[73] Assignees: The Japan Steel Works, Ltd., Tokyo; Toshiba Corporation, Kanagawa, both of Japan

[21] Appl. No.: 461,404

[22] Filed: Jun. 5, 1995

[30] Foreign Application Priority Data

Jun. 13, 1994 [JP] Japan ..... 6-153077

[51] Int. Cl.[6] ..... C22C 38/18

[52] U.S. Cl. ..... 148/326; 420/37; 420/38

[58] Field of Search ..... 148/325, 326; 420/37, 38

[56] References Cited

U.S. PATENT DOCUMENTS

| | | | |
|---|---|---|---|
| 5,061,440 | 10/1991 | Watanabe et al. | 420/38 |
| 5,310,431 | 5/1994 | Buck | 148/325 |
| 5,415,706 | 5/1995 | Scarlin et al. | 148/325 |

FOREIGN PATENT DOCUMENTS

| | | |
|---|---|---|
| 0384433 | 8/1990 | European Pat. Off. . |
| 54-121219 | 9/1979 | Japan . |
| 54-115617 | 9/1979 | Japan . |
| 59-179718 | 10/1984 | Japan . |
| 2-197550 | 8/1990 | Japan . |
| 2-290950 | 11/1990 | Japan . |
| 3-53047 | 3/1991 | Japan . |
| 4-147948 | 5/1992 | Japan . |
| 4-371552 | 12/1992 | Japan . |
| 5-212582 | 8/1993 | Japan . |
| 5-263196 | 10/1993 | Japan . |
| 5-311344 | 11/1993 | Japan . |
| 5-311345 | 11/1993 | Japan . |
| 6-142981 | 5/1994 | Japan . |

*Primary Examiner*—Sikyin Ip
*Attorney, Agent, or Firm*—Oliff & Berridge

[57] ABSTRACT

A heat resisting steels comprising, on percentage by weight basis, 0.05 to 0.2% of C, not more than 1.0% of Ni, 9 to 13% of Cr, 0.05 to 1% of Mo, 0.05 to 0.3% of V, 1 to 3% of W, 1 to 5% of Co, 0.01 to 0.1% of N, at least one member selected from 0.01 to 0.15% of Nb, 0.01 to 0.15% of Ta, 0.003 to 0.03% of a rare earth element, 0.003 to 0.03% of Ca and 0.003 to 0.03% of B, and the remainder of Fe and unavoidable impurities have enhanced high temperature characteristics and are suitable for use in parts of turbine such as turbine rotors, turbine blades, turbine disks and bolts.

4 Claims, No Drawings

HEAT RESISTING STEELS

FIELD OF THE INVENTION

This invention relates to heat resisting steels suitable for use in parts of turbine such as turbine rotors, turbine blades, turbine disks and bolts.

BACKGROUND OF THE INVENTION

In the thermal power generation system, there has been a tendency to drastically increase the steam temperature of the steam turbine in order to enhance the generating efficiency. As a result, the required high temperature characteristics become more strict. Many materials for use in such application have hitherto been suggested. Amongst them, it has been known that the development heat resisting steels suggested in JP-A-2-290950 (the term "JP-A" used herein means an unexamined Japanese patent application) and JP-A-4-147948 (the components used are the same but the intended uses are different from each other) are excellent in high temperature strength.

However, in order to further enhance the power generation efficiency for use in raw materials for turbines, the above-mentioned development heat resisting steels do not yet have sufficient high temperature characteristics, and heat temperature characteristics including high temperature creep strength need to be further enhanced. Moreover, the conventional materials are also problematic in that their toughness is reduced by long-time aging at high temperature and, thus their durability is poor. It has been desired to improve the characteristics of the heat resisting steels including the characteristics described above.

We have carried out the improvement in the abovementioned heat resisting steels in light of the following viewpoints in order to make it possible to highly enhance the generating efficiency and enhance durability:

(1) Enhancement of high temperature creep strength (2) Prevention of deterioration of toughness by long-time aging at high temperature (3) Enhancement of toughness As a result of our studies, the following means are available for attaining the above objects:

(1) The enhancement of high temperature creep strength can be realized by containing Nb, Ta and B and decreasing the Mn content.

(2) The prevention of deterioration of toughness by long-time aging at high temperature can be realized by decreasing the contents of Si, Mn, P, As, Sn and Sb (3) The enhancement of toughness can be realized by containing a rare earth element and Ca and decreasing the S content.

The present invention has been done based on the above circumstances, and an object of the present invention is to provide a heat resisting steel having excellent high temperature characteristics and durability by enhancing the high temperature creep strength, preventing the deterioration of the toughness by long-time aging at high temperature and enhancing toughness.

SUMMARY OF THE INVENTION

The heat resisting steel according to the first aspect of the present invention in order to solve the above problems comprises, on percentage by weight basis, 0.05 to 0.2% of C, not more than 1.0% of Ni, 9 to 13% of Cr, 0.05 to 1% of Mo, 0.05 to 0.3% of V, 1 to 3% of W, 1 to 5% of Co, 0.01 to 0.1% of N, at least one member selected from 0.01 to 0.15% of Nb, 0.01 to 0.15% of Ta, 0.003 to 0.03% of a rare earth element, 0.003 to 0.03% of Ca and 0.003 to 0.03% of B, and the remainder of Fe and unavoidable impurities. The rare earth element may comprises one or more and include La, Ce, or the like.

The heat resisting steel according to the second aspect of the present invention is characterized in that in the first aspect of the present invention, in the above unavoidable impurities, the allowable content of Si is not more than 0.1%, that of Mn is not more than 0.15%, and that of P is not more than 0.01%.

The heat resisting steel according to the third aspect of the present invention is characterized in that in the first or second aspect of the present invention, in the above unavoidable impurities, the allowable content of S is not more than 0.005%, that of As is not more than 0.005%, that of Sn is not more than 0.005%, and that of Sb is not more than 0.003%.

DETAILED DESCRIPTION OF THE INVENTION

The functions and the reasons for the restriction of ingredient elements will now be described.

C: 0.05 to 0.2%

C is an element necessary for accelerating martensite transformation and for bonding to Fe, Cr, Mo, V, Nb, etc. to form a carbide to enhance the high temperature strength. From such viewpoints, C requires at least 0.05%. If C is contained in an amount exceeding 0.2%, there is a tendency to form a large-sized carbide, deteriorating high temperature creep strength. For this reason, the content is restricted to from 0.05 to 0.2%. For the same reasons, the content is preferably restricted to from 0.09 to 0.13%.

Ni: not more than 1.0%

There are two cases where Ni is positively contained and where no Ni is contained. In the case where toughness is especially required, Ni is positively required to be added and contained, in which case, if the content exceeds 1%, the creep rupture strength is reduced. For this reason, the upper restriction is set at 1%. The preferable range is from 0.25 to 0.65%.

Even in the case of adding no Ni, Ni is unavoidably contained in an amount of not more than 0.25%.

Cr: 9 to 13%

Cr is an element necessary for enhancing oxidation resistance and anti-corrosion at a high temperature, and is required in an amount of at least 9%. However if, the content exceeds 13%, harmful δ-ferrite is formed to deteriorate high temperature strength and toughness. Therefore, the content is set within the range of 9 to 13%. For the same reasons, the content is preferably restricted to from 9.7 to 11.8%.

Mo: 0.05 to 1%

Mo is solid-solubilized in the alloy to enhance strength both at a high temperature and a low temperature and to form a fine carbide, which enhances the high temperature creep strength. This is an element contributing to suppression of temper brittleness, and is required in an amount of at least 0.05%. If the content exceeds 1%, a δ-ferrite is formed to deteriorate the creep strength. Therefore, the content is restricted to from 0.05 to 1%. For the same reasons, the content is preferably from 0.5 to 1%, more preferably from 0.5 to 0.7%.

V: 0.05 to 0.3%

V is available for forming a fine carbide and nitrogen carbide to enhance a high temperature creep strength and is required in an amount of at least 0.05%. If the content exceeds 0.3%, carbon is excessively fixed to increase the amount of carbide separated causing a reduced high temperature strength. Therefore, the content is restricted to from 0.05 to 0.3%. For the same reasons, the content is preferably restricted to from 0.15 to 0.25%.

W: 1 to 3%

W suppresses the aggregation and enlargement of carbide and is solid-solubilized into the alloy to solid-solubilize and strengthen the matrix and, therefore, is available for enhancing the high temperature strength and is required in an amount of at least 1%. However, if the content exceeds 3%, there is a tendency to form a δ-ferrite and a Laves phase, which reduce the high temperature strength. Therefore, the content is restricted to from 1 to 3%. For the same reasons, the content is preferably restricted to from 1 to 2%, and more preferably from 1.3 to 1.6%.

Co: 1 to 5%

Co suppresses the formation of δ-ferrite to enhance the high temperature strength. Co is required in an amount of 1% or more in order to suppress the formation of δ-ferrite, but if it is contained in an amount exceeding 5%, the ductility is reduced and the cost is increased. Therefore, the content is restricted to not more than 5%. For the same reasons, the content is preferably restricted to from 1.5 to 4%, and more preferably from 2.0 to 3.5%.

N: 0.01 to 0.1%

N is bonded to Nb, V, etc to form a nitride, enhancing the high temperature creep strength. If the content is not more than 0.01%, no sufficient strength can be obtained. Conversely, if it exceeds 0.1%, it is difficult to produce an ingot and the hot processing ability is changed for the worse. Therefore, the content is restricted to from 0.01 to 0.1%. For the same reasons, the content is preferably restricted to from 0.02 to 0.04%, and more preferably from 0.02 to 0.03%.

Nb and Ta: 0.01 to 0.15%

Nb and/or Ta form a fine carbide and carbo-nitride to enhance the high temperature strength and attain fine grain microstructure to enhance the low temperature toughness and, thus, they are contained alone or jointly. In order to exhibit such effects, it is required to contain them in an amount of at least 0.01%. However, if they are contained in an amount exceeding 0.15%, a large-sized carbide and nitrogen carbide are separated for reducing the toughness. Therefore, the upper limit is set at 0.15%. In the case of joint use, the content of (Nb+Ta) is preferably not more than 0.15%. More desirably, the content of (Nb+Ta) is from 0.03 to 0.08%.

Rare earth elements: 0.003 to 0.03%; Ca: 0.003 to 0.03%

The rare earth elements and Ca have functions of deacidification and desulfurization and, thus, the single or joint addition of the rare earth elements and Ca makes it possible to control the shape and distribution of internally existing non-metal impurities. As a result, the absorption impact energy is enhanced to improve the toughness. Therefore, they are optionally contained.

However, if the content is not more than 0.003%, the functions and effects described above cannot be exhibited. If they are contained in an amount exceeding 0.03%, oxides are excessively formed which reduce the cleanliness, resulting in reduced impact toughness. Therefore, the contents of the rare earth elements and Ca are restricted to the ranges described above.

B: 0.003 to 0.03%

A trace content of B increases hardenability to enhance the toughness and, at the same time, suppresses the separation and aggregation of the carbide in the interface and interior of particles to contribute to enhancement of the high temperature creep strength. However, if the content is less than 0.003%, the above effects are insufficient, while if it exceeds 0.03%, the high temperature creep ductility is drastically reduced. Therefore, the content is restricted to from 0.003 to 0.03%. For the same reasons, the content is preferably restricted to from 0.005 to 0.02%.

(Unavoidable impurities)

Si: not more than 0.1%

Si is usually utilized as a deacidification agent, but if the Si content is too high, segregation in the steel is increased and sensitivity to tempering brittleness becomes very high and loses the cutting toughness; furthermore, when being stored at a high temperature for a long period of time, the change of the state of the separations is accelerated, causing the deterioration of the toughness by long-time aging at high temperature. Therefore, the content of Si is desirably reduced as much as possible. Considering the commercial scale, the content is restricted to not more than 0.1%. For the same reasons, the content is preferably restricted to not more than 0.05%, and more preferably not more than 0.03%.

Mn: not more than 0.15%

Mn is generally used as a deacidification and desulfurization agent during the course of melting. However, since Mn is bonded to S to form a non-metallic inclusion which reduces the toughness and, at the same time accelerates the deterioration of toughness by long-time aging at high temperature and reduces the high temperature creep strength, the content of Mn is desirably reduced. At present, with the development of refining technologies such as furnace refining, the reduction of the amount of S becomes easy and thus, the need for the addition of Mn as a desulfurization agent is reduced. In the present invention, Mn is considered as an unavoidable impurity and the allowable content is restricted to not more than 0.15% considering the limitation of the refining technology. The content is preferably restricted to not more than 0.1%, and more preferably less than 0.05%.

P: not more than 0.01%

P is an element which increases the sensitivity to temper brittleness and accelerates the deterioration of toughness by long-time aging at high temperature. It is, therefore, desirable for reducing the deterioration by long-time aging at high temperature and improving the reliability to reduce the content as much as possible. Considering the limitation of refining technology, the allowable content is restricted to not more than 0.01%. The content is preferably restricted to not more than 0.008%, and more preferably not more than 0.005%.

S: not more than 0.005%

Since S accelerates the formation of macro-uneven separation in a large-sized steel mass and forms together with Mn, Fe, Nb, V, etc. a sulfide which deteriorates the toughness, the content is desirably reduced as much as possible. Considering the limitation of refining technology, the allowable content is restricted to not more than 0.005%.

As: not more than 0.005%, Sn: not more than 0.005%, Sb: not more than 0.003%

As, Sn, and Sb are elements which increase the sensitivity to temper brittleness similar to P, and, thus, they are desirable to be reduced as much as possible. However, these impure elements are unavoidably contained in the raw material, and it is difficult to remove them by refining. Therefore, minimal content is largely due to strict selection of the raw material. From the view point of reducing the sensitivity to temper brittleness, the As content is restricted to not more than 0.005%, Sn to not more than 0.005%, and Sb to not more than 0.003%.

EXAMPLE

Using the compositions as shown in Tables 1 and 2 as the target values, 50 kg of each steel mass was melted in a vacuum induction furnace, forged at 1150° C., then into a shape of rotor shaft. From these forged materials, test materials were cut, heat treatment was carried out to simulate actual heat histories of rotor shaft corresponding to shaft core. To be specific, oil hardening was applied from a temperature of 1050° C., and thereafter a first tempering was applied at 570° C., and then a second tempering was applied at 700° C. to make test samples.

The test samples after tempering were subjected to a high temperature creep test and an impact test. The tempered test samples were subjected to an aging treatment at 600° C. and 400° C. for 3,000 hours and then to an impact test. The results of the creep test were shown as the breaking time at 680° C. and at a load of 17.5 kgf/mm$^2$. The results of the impact test are shown as ΔFATT which is a difference between FATT (fracture appearance transition temperature) after the ageing treatment and FATT of the test sample which was only applied to tempering. The test results are shown in Table 3.

TABLE 1

| | Alloy Elements (wt %) | | | | | | | | | | | | |
|---|---|---|---|---|---|---|---|---|---|---|---|---|---|
| | C | Ni | Cr | Mo | V | W | Co | Nb | N | Ta | B | REM | Ca |
| Present Sample | | | | | | | | | | | | | |
| 1 | 0.11 | 0.32 | 11.0 | 0.61 | 0.19 | 1.5 | 3.1 | — | 0.022 | — | 0.022 | — | — |
| 2 | 0.09 | 0.32 | 11.1 | 0.51 | 0.20 | 1.6 | 3.0 | — | 0.021 | — | — | 0.007 | — |
| 3 | 0.10 | 0.52 | 10.8 | 0.55 | 0.18 | 1.6 | 3.1 | — | 0.024 | — | 0.021 | 0.008 | — |
| 4 | 0.11 | 0.10 | 10.8 | 0.58 | 0.20 | 1.5 | 3.1 | — | 0.026 | — | — | — | 0.008 |
| 5 | 0.11 | 0.50 | 10.5 | 0.60 | 0.19 | 1.6 | 2.5 | — | 0.022 | — | 0.023 | — | 0.006 |
| 6 | 0.10 | 0.26 | 11.1 | 0.57 | 0.21 | 1.6 | 2.8 | — | 0.023 | — | — | 0.005 | 0.010 |
| 7 | 0.09 | 0.25 | 11.4 | 0.58 | 0.19 | 1.5 | 2.0 | — | 0.028 | — | 0.016 | 0.007 | 0.005 |
| 8 | 0.10 | 0.41 | 11.0 | 0.55 | 0.20 | 1.6 | 2.0 | 0.06 | 0.023 | — | — | — | — |
| 9 | 0.10 | 0.17 | 9.8 | 0.56 | 0.20 | 1.5 | 1.6 | 0.07 | 0.028 | — | 0.008 | — | — |
| 10 | 0.09 | 0.47 | 11.0 | 0.58 | 0.19 | 1.5 | 2.5 | 0.07 | 0.022 | — | — | 0.007 | — |
| 11 | 0.10 | 0.54 | 11.1 | 0.52 | 0.20 | 1.5 | 2.6 | 0.05 | 0.024 | — | 0.018 | 0.010 | — |
| 12 | 0.11 | 0.55 | 10.8 | 0.54 | 0.20 | 1.6 | 2.4 | 0.05 | 0.021 | — | — | — | 0.009 |
| 13 | 0.09 | 0.40 | 10.8 | 0.51 | 0.20 | 1.5 | 2.6 | 0.05 | 0.021 | — | 0.014 | — | 0.010 |
| 14 | 0.13 | 0.56 | 10.3 | 0.66 | 0.20 | 1.6 | 2.6 | 0.06 | 0.020 | — | — | 0.005 | 0.005 |
| 15 | 0.09 | 0.41 | 11.4 | 0.80 | 0.20 | 1.0 | 4.5 | 0.05 | 0.026 | — | 0.022 | 0.005 | 0.010 |
| 16 | 0.09 | 0.55 | 11.7 | 0.51 | 0.18 | 1.5 | 3.0 | — | 0.029 | 0.07 | — | — | — |
| 17 | 0.10 | 0.58 | 11.0 | 0.56 | 0.19 | 1.6 | 3.0 | — | 0.026 | 0.06 | 0.018 | — | — |
| 18 | 0.10 | 0.33 | 11.0 | 0.63 | 0.18 | 1.6 | 3.1 | — | 0.023 | 0.06 | — | 0.008 | — |
| 19 | 0.09 | 0.10 | 9.7 | 0.68 | 0.19 | 1.6 | 2.5 | — | 0.022 | 0.06 | 0.014 | 0.007 | — |
| 20 | 0.10 | 0.39 | 10.9 | 0.60 | 0.19 | 1.5 | 2.5 | — | 0.021 | 0.05 | — | — | 0.015 |
| 21 | 0.06 | 0.49 | 11.4 | 0.65 | 0.20 | 1.6 | 2.5 | — | 0.040 | 0.08 | 0.008 | — | 0.010 |
| 22 | 0.06 | 0.12 | 11.3 | 0.10 | 0.22 | 2.8 | 4.5 | — | 0.039 | 0.06 | — | 0.006 | 0.006 |
| 23 | 0.10 | 0.47 | 11.3 | 0.53 | 0.20 | 1.6 | 2.8 | — | 0.020 | 0.05 | 0.009 | 0.005 | 0.005 |
| 24 | 0.10 | 0.36 | 11.0 | 0.63 | 0.20 | 1.6 | 1.9 | — | 0.040 | 0.08 | 0.008 | 0.005 | 0.004 |
| 25 | 0.10 | 0.54 | 10.3 | 0.52 | 0.18 | 1.6 | 2.5 | 0.04 | 0.027 | 0.03 | — | — | — |
| 26 | 0.10 | 0.57 | 10.8 | 0.53 | 0.19 | 1.5 | 2.6 | 0.03 | 0.023 | 0.03 | 0.011 | — | — |
| 27 | 0.09 | 0.08 | 11.3 | 0.53 | 0.20 | 1.6 | 2.2 | 0.03 | 0.029 | 0.03 | — | 0.008 | — |
| 28 | 0.09 | 0.30 | 11.0 | 0.11 | 0.20 | 2.8 | 2.1 | 0.02 | 0.025 | 0.05 | 0.010 | 0.007 | — |
| 29 | 0.10 | 0.42 | 11.1 | 0.56 | 0.18 | 1.6 | 2.8 | 0.03 | 0.027 | 0.03 | 0.011 | — | 0.010 |
| 30 | 0.09 | 0.09 | 10.1 | 0.60 | 0.21 | 1.6 | 2.5 | 0.04 | 0.023 | 0.03 | — | — | 0.010 |
| 31 | 0.12 | 0.51 | 10.4 | 0.63 | 0.18 | 1.6 | 3.1 | 0.03 | 0.027 | 0.03 | 0.015 | — | 0.015 |
| 32 | 0.10 | 0.44 | 10.6 | 0.61 | 0.20 | 1.5 | 3.1 | 0.03 | 0.022 | 0.04 | — | 0.006 | 0.005 |
| 33 | 0.14 | 0.58 | 10.3 | 0.13 | 0.16 | 2.7 | 3.0 | 0.03 | 0.025 | 0.03 | 0.023 | 0.005 | 0.006 |
| 34 | 0.09 | 0.57 | 10.7 | 0.60 | 0.20 | 1.6 | 2.6 | 0.04 | 0.022 | 0.03 | 0.014 | 0.005 | 0.005 |
| 35 | 0.10 | 0.19 | 10.2 | 0.65 | 0.20 | 1.5 | 2.8 | 0.05 | 0.022 | — | 0.009 | — | — |
| 36 | 0.11 | 0.20 | 10.1 | 0.22 | 0.19 | 1.4 | 2.7 | 0.06 | 0.019 | — | 0.011 | — | — |
| 37 | 0.10 | 0.19 | 10.3 | 0.63 | 0.19 | 2.4 | 2.6 | 0.06 | 0.021 | — | 0.010 | — | — |
| 38 | 0.10 | 0.20 | 10.1 | 0.62 | 0.19 | 1.6 | 1.3 | 0.05 | 0.019 | — | 0.010 | — | — |

TABLE 1-continued

| | Alloy Elements (wt %) | | | | | | | | | | | | |
|---|---|---|---|---|---|---|---|---|---|---|---|---|---|
| | C | Ni | Cr | Mo | V | W | Co | Nb | N | Ta | B | REM | Ca |
| 39 Comparative Sample | 0.11 | 0.20 | 10.0 | 0.66 | 0.20 | 1.5 | 4.3 | 0.05 | 0.020 | — | 0.009 | — | — |
| 1 | 0.12 | 1.23 | 9.9 | 0.26 | 0.18 | 2.7 | 2.7 | 0.06 | 0.048 | — | — | — | — |
| 2 | 0.13 | 0.60 | 10.5 | 0.16 | 0.18 | 2.1 | — | 0.10 | 0.038 | — | — | — | — |
| 3 | 0.15 | 1.68 | 11.0 | 0.27 | 0.20 | 2.5 | 6.0 | 0.06 | 0.055 | — | — | — | — |
| 4 | 0.15 | 0.60 | 11.1 | 1.02 | 0.20 | 1.0 | — | 0.08 | 0.045 | — | 0.012 | — | — |
| 5 | 0.15 | 0.58 | 10.0 | 1.20 | 0.21 | 0.3 | — | 0.10 | 0.045 | — | 0.010 | — | — |

REM: rare earth element

TABLE 2

| | Impurity Elements | | | | | | |
|---|---|---|---|---|---|---|---|
| | Si | Mn | P | S | As | Sn | Sb |
| Present Sample | | | | | | | |
| 1 | 0.01 | 0.02 | 0.003 | 0.002 | 0.003 | 0.003 | 0.001 |
| 2 | 0.01 | 0.01 | 0.003 | 0.002 | 0.003 | 0.003 | 0.001 |
| 3 | 0.01 | 0.02 | 0.003 | 0.002 | 0.003 | 0.003 | 0.001 |
| 4 | 0.01 | 0.01 | 0.003 | 0.002 | 0.003 | 0.003 | 0.001 |
| 5 | 0.01 | 0.01 | 0.003 | 0.002 | 0.003 | 0.003 | 0.001 |
| 6 | 0.01 | 0.01 | 0.003 | 0.002 | 0.003 | 0.003 | 0.001 |
| 7 | 0.01 | 0.01 | 0.003 | 0.002 | 0.003 | 0.003 | 0.001 |
| 8 | 0.01 | 0.02 | 0.003 | 0.002 | 0.003 | 0.003 | 0.001 |
| 9 | 0.01 | 0.01 | 0.003 | 0.002 | 0.003 | 0.003 | 0.001 |
| 10 | 0.01 | 0.01 | 0.003 | 0.002 | 0.003 | 0.003 | 0.001 |
| 11 | 0.01 | 0.01 | 0.003 | 0.002 | 0.003 | 0.003 | 0.001 |
| 12 | 0.01 | 0.02 | 0.003 | 0.002 | 0.003 | 0.003 | 0.001 |
| 13 | 0.01 | 0.02 | 0.003 | 0.002 | 0.003 | 0.003 | 0.001 |
| 14 | 0.01 | 0.01 | 0.003 | 0.002 | 0.003 | 0.003 | 0.001 |
| 15 | 0.01 | 0.01 | 0.003 | 0.002 | 0.003 | 0.003 | 0.001 |
| 16 | 0.01 | 0.02 | 0.003 | 0.002 | 0.003 | 0.003 | 0.001 |
| 17 | 0.01 | 0.01 | 0.003 | 0.002 | 0.003 | 0.003 | 0.001 |
| 18 | 0.01 | 0.01 | 0.003 | 0.002 | 0.003 | 0.003 | 0.001 |
| 19 | 0.01 | 0.02 | 0.003 | 0.002 | 0.003 | 0.003 | 0.001 |
| 20 | 0.01 | 0.02 | 0.003 | 0.002 | 0.003 | 0.003 | 0.001 |
| 21 | 0.01 | 0.01 | 0.003 | 0.002 | 0.003 | 0.003 | 0.001 |
| 22 | 0.01 | 0.01 | 0.003 | 0.002 | 0.003 | 0.003 | 0.001 |
| 23 | 0.01 | 0.02 | 0.003 | 0.002 | 0.003 | 0.003 | 0.001 |

TABLE 2-continued

| | Impurity Elements | | | | | | |
|---|---|---|---|---|---|---|---|
| | Si | Mn | P | S | As | Sn | Sb |
| 24 | 0.01 | 0.10 | 0.003 | 0.002 | 0.003 | 0.003 | 0.001 |
| 25 | 0.01 | 0.01 | 0.003 | 0.002 | 0.003 | 0.003 | 0.001 |
| 26 | 0.01 | 0.02 | 0.003 | 0.002 | 0.003 | 0.003 | 0.001 |
| 27 | 0.01 | 0.01 | 0.003 | 0.002 | 0.003 | 0.003 | 0.001 |
| 28 | 0.01 | 0.01 | 0.003 | 0.002 | 0.003 | 0.003 | 0.001 |
| 29 | 0.01 | 0.01 | 0.003 | 0.002 | 0.003 | 0.003 | 0.001 |
| 30 | 0.01 | 0.01 | 0.003 | 0.002 | 0.003 | 0.003 | 0.001 |
| 31 | 0.01 | 0.02 | 0.003 | 0.002 | 0.003 | 0.003 | 0.001 |
| 32 | 0.01 | 0.01 | 0.003 | 0.002 | 0.003 | 0.003 | 0.001 |
| 33 | 0.01 | 0.01 | 0.003 | 0.002 | 0.003 | 0.003 | 0.001 |
| 34 | 0.01 | 0.10 | 0.003 | 0.002 | 0.003 | 0.003 | 0.001 |
| 35 | 0.01 | 0.02 | 0.003 | 0.002 | 0.003 | 0.003 | 0.001 |
| 36 | 0.01 | 0.01 | 0.003 | 0.002 | 0.003 | 0.003 | 0.001 |
| 37 | 0.01 | 0.01 | 0.003 | 0.002 | 0.003 | 0.003 | 0.001 |
| 38 | 0.01 | 0.02 | 0.003 | 0.002 | 0.003 | 0.003 | 0.001 |
| 39 | 0.01 | 0.01 | 0.003 | 0.002 | 0.003 | 0.003 | 0.001 |
| Comparative Sample | | | | | | | |
| 1 | 0.21 | 0.54 | 0.021 | 0.013 | 0.011 | 0.010 | 0.005 |
| 2 | 0.17 | 0.56 | 0.019 | 0.010 | 0.011 | 0.010 | 0.005 |
| 3 | 0.19 | 0.55 | 0.020 | 0.008 | 0.010 | 0.008 | 0.006 |
| 4 | 0.18 | 0.60 | 0.020 | 0.013 | 0.013 | 0.008 | 0.006 |
| 5 | 0.18 | 0.55 | 0.020 | 0.015 | 0.011 | 0.008 | 0.006 |

TABLE 3

| | Creep Rupture Time (h) | Impact Test: 20° C. Impact Value (kgf-m) | Impact Test: Tempering FATT (°C.) | After Ageing Treatment at 600° C. × 3000 h: FATT (°C.) | After Ageing Treatment at 600° C. × 3000 h: ΔFATT (°C.) | After Ageing Treatment at 400° C. × 3000 h: FATT (°C.) | After Ageing Treatment at 400° C. × 3000 h: ΔFATT (°C.) |
|---|---|---|---|---|---|---|---|
| Present Sample | | | | | | | |
| 1 | 289 | 4.4 | 60 | 68 | 8 | 60 | 0 |
| 2 | 240 | 4.2 | 66 | 77 | 11 | 69 | 3 |
| 3 | 272 | 4.1 | 64 | 74 | 10 | 64 | 0 |
| 4 | 243 | 4.5 | 71 | 80 | 9 | 71 | 0 |
| 5 | 278 | 4.0 | 68 | 80 | 12 | 71 | 3 |
| 6 | 242 | 3.8 | 64 | 75 | 11 | 66 | 2 |
| 7 | 291 | 4.0 | 63 | 73 | 10 | 67 | 4 |
| 8 | 255 | 3.6 | 67 | 77 | 10 | 70 | 3 |
| 9 | 303 | 3.7 | 74 | 86 | 12 | 74 | 0 |
| 10 | 231 | 4.3 | 58 | 70 | 12 | 58 | 0 |
| 11 | 326 | 4.1 | 72 | 80 | 8 | 72 | 0 |
| 12 | 256 | 3.8 | 63 | 74 | 11 | 68 | 5 |

TABLE 3-continued

| | Creep Rupture Time (h) | Impact Test: 20° C. Impact Value (kgf-m) | Impact Test: Tempering FATT (°C.) | Impact Test: After Ageing Treatment at 600° C. × 3000 h FATT (°C.) | Impact Test: After Ageing Treatment at 600° C. × 3000 h ΔFATT (°C.) | Impact Test: After Ageing Treatment at 400° C. × 3000 h FATT (°C.) | Impact Test: After Ageing Treatment at 400° C. × 3000 h ΔFATT (°C.) |
|---|---|---|---|---|---|---|---|
| 13 | 324 | 3.4 | 77 | 80 | 3 | 80 | 3 |
| 14 | 285 | 4.1 | 67 | 73 | 6 | 69 | 2 |
| 15 | 262 | 3.8 | 69 | 78 | 9 | 71 | 2 |
| 16 | 279 | 3.3 | 73 | 78 | 5 | 73 | 0 |
| 17 | 388 | 3.6 | 65 | 71 | 6 | 65 | 0 |
| 18 | 265 | 3.3 | 64 | 74 | 10 | 67 | 3 |
| 19 | 304 | 3.3 | 66 | 72 | 6 | 66 | 0 |
| 20 | 287 | 3.6 | 70 | 74 | 4 | 72 | 2 |
| 21 | 288 | 3.9 | 76 | 83 | 7 | 77 | 1 |
| 22 | 296 | 4.2 | 71 | 75 | 4 | 71 | 0 |
| 23 | 325 | 4.0 | 73 | 86 | 13 | 77 | 4 |
| 24 | 255 | 4.3 | 67 | 79 | 12 | 74 | 7 |
| 25 | 295 | 3.7 | 68 | 75 | 7 | 68 | 0 |
| 26 | 282 | 3.3 | 68 | 74 | 6 | 70 | 2 |
| 27 | 296 | 3.5 | 62 | 69 | 7 | 64 | 2 |
| 28 | 260 | 3.5 | 62 | 77 | 15 | 62 | 0 |
| 29 | 317 | 4.8 | 71 | 79 | 8 | 71 | 0 |
| 30 | 278 | 3.8 | 68 | 74 | 6 | 74 | 6 |
| 31 | 337 | 4.6 | 78 | 88 | 10 | 78 | 0 |
| 32 | 308 | 3.5 | 76 | 80 | 4 | 79 | 3 |
| 33 | 300 | 3.4 | 70 | 81 | 11 | 75 | 5 |
| 34 | 274 | 3.8 | 69 | 81 | 12 | 78 | 9 |
| 35 | 396 | 3.6 | 72 | 81 | 9 | 73 | 1 |
| 36 | 243 | 4.4 | 65 | 75 | 10 | 67 | 2 |
| 37 | 335 | 3.3 | 82 | 95 | 12 | 82 | 0 |
| 38 | 287 | 3.7 | 75 | 87 | 12 | 75 | 0 |
| 39 | 279 | 4.1 | 74 | 80 | 6 | 77 | 3 |
| Comparative Sample | | | | | | | |
| 1 | 161 | 2.2 | 90 | 130 | 40 | 108 | 18 |
| 2 | 167 | 1.7 | 94 | 142 | 48 | 115 | 21 |
| 3 | 112 | 2.4 | 83 | 124 | 41 | 99 | 16 |
| 4 | 171 | 1.8 | 87 | 130 | 43 | 103 | 16 |
| 5 | 172 | 1.9 | 97 | 134 | 37 | 117 | 20 |

As is clear from Table 3, in the test samples of the present invention (The inventive steel Nos. 1 to 39), excellent characteristics were obtained in all tested items in comparison with the comparative samples (Comparative steel Nos. 1 to 5). Particularly, the inventive steel Nos. 1–39 containing very few contents of impurity elements show prevention of the deterioration in the toughness by long-time aging at high temperature as compared to comparative steel Nos. 1–5.

Further, of the inventive steel Nos. 35–39, No. 35 in which all the added elements are contained in the amounts of preferred range as defined above respectively is apparently excellent in creep rupture time as compared to Nos. 36–39 in which all the added elements except Mo (No. 36), W (No. 37), or Co (Nos. 38 and 39) are contained in the amounts of preferred range. Therefore, it is clear that more excellent characteristics are obtained by adjusting the amounts of the added elements to the preferred range as defined above.

According to the heat resisting steels of the present invention, which have enhanced high temperature characteristics, applying them to a turbine rotor or turbine part, it becomes possible to increase the steam temperature to contribute to the enhancement of the generating efficiency. Since the steels possess increased toughness and the deterioration of their toughness by long-time aging at high temperature is prevented and, thus, the steels have an effect of improving the safety of the plant.

Moreover, apart from the applications to the turbine rotor and turbine part, they can be provided as raw materials having excellent high temperature characteristics and durability.

While the invention has been described in detail and with reference to specific embodiments thereof, it will be apparent to one skilled in the art that various changes and modifications can be made therein without departing from the spirit and scope thereof.

What is claimed is:

1. A heat resisting steel consisting essentially of, on percentage by weight basis, 0.05 to 0.2% of C, not more than 1.0% of Ni, 9 to 13% of Cr, 0.05 to 1% of Mo, 0.05 to 0.3% of V, 1 to 3% of W, 1 to 5% of Co, 0.01 to 0.1% of N, at least one member selected from the group consisting of 0.003 to 0.03% of a rare earth element and 0.003 to 0.03% of Ca, at least one member selected from the group consisting of 0.01 to 0.15% of Nb, 0.01 to 0.15% of Ta and 0.003 to 0.03% of B, and the remainder of Fe and unavoidable impurities.

2. A heat resisting steel as claimed in claim 1, wherein in the above unavoidable impurities, the allowable content of Si is not more than 0.1%, that of Mn is not more than 0.15%, and that of P is not more than 0.01%.

3. A heat resisting steel as claimed in claim 1, wherein in the above unavoidable impurities, the allowable content of S is not more than 0.005%, that of As is not more than 0.005%, that of Sn is not more than 0.005%, and that of Sb is not more than 0.003%.

4. A heat resisting steel as claimed in claim 2, wherein in the above unavoidable impurities, the allowable content of S is not more than 0.005%, that of As is not more than 0.005%, that of Sn is not more than 0.005%, and that of Sb is not more than 0.003%.

* * * * *